United States Patent [19]

Fellnor et al.

[11] 4,162,891

[45] Jul. 31, 1979

[54] SCRAP PREHEATER MODULAR ROOF ASSEMBLY

[75] Inventors: John R. Fellnor, Burlington, N.J.; William J. Love, Jr., Perkasie, Pa.

[73] Assignee: Melting Systems, Incorporated, Burlington, N.J.

[21] Appl. No.: 829,901

[22] Filed: Sep. 1, 1977

[51] Int. Cl.[2] ..... F27D 1/18

[52] U.S. Cl. ..... 432/247; 432/250

[58] Field of Search ..... 432/247, 250

[56] References Cited

U.S. PATENT DOCUMENTS

| | | | |
|---|---|---|---|
| 1,400,335 | 12/1921 | Wensiulis | 432/250 |
| 2,991,060 | 7/1961 | Sklenar | 432/250 |
| 3,511,483 | 5/1970 | Gentry | 432/250 |
| 3,813,209 | 5/1974 | Venetta | 432/11 |
| 3,985,497 | 10/1976 | Fellnor et al. | 432/72 |

*Primary Examiner*—John J. Camby
*Attorney, Agent, or Firm*—Duffield & Lehrer

[57] ABSTRACT

A scrap preheating system in which scrap metal is preheated and contaminants such as grease removed therefrom by direct impingement of flames upon the scrap. The system includes a tunnel like preheater hood through which a conveyor passes conveying the scrap. The preheater hood includes parallel side walls positioned adjacent the conveyor and a roof assembly in which are positioned a plurality of burners for directing flames upon the scrap. The roof assembly of the preheater hood is formed into a plurality of substantially identical modular roof assemblies which are carried by the side walls and are positioned in side by side relationship along the side walls transverse to the longitudinal axis of the conveyor.

6 Claims, 4 Drawing Figures

SCRAP PREHEATER MODULAR ROOF ASSEMBLY

BACKGROUND OF INVENTION

The present invention applies to improvements in scrap preheating systems of the type shown in U.S. Pat. No. 3,985,497 issued Oct. 12, 1976 and application Ser. No. 710,750 filed Aug. 2, 1976, now U.S. Pat. No. 4,083,675, and more specifically to improvements in the roof structures of such preheater hoods.

Scrap preheaters are finding increasing use in the basic iron and steel industry as an effective means for recovering and reusing scrap iron and steel. Scrap preheaters accomplish at least two basic functions. The first is to burn off and remove from the scrap such undesirable elements as water, grease and the like. Additionally, it is preferable to charge preheated scrap into furnaces, such as induction furnaces, in order to reduce the overall time for the batch to reach pouring temperature.

Scrap preheaters are basically elongate tunnel like devices through which a conveyor passes which carries the scrap steel. Gas or oil burners are positioned within the tunnel and the flames from the burners are directed upon the scrap material to heat the material and remove the moisture and hydrocarbons from the material. Thereafter, the preheated and cleansed material is charged into a melting furnace.

A more detailed description of a preferred structure of scrap preheating assembly and the operation thereof is set forth in the aforementioned patent and patent application. The disclosure in the aforementioned patent and patent application is hereby incorporated herein by reference thereto and reference should be made to the patent and patent application for a more detailed understanding of the details of the entire structure of a preheater hood as well as the operation thereof.

A typical preheater hood, for example of the size generally shown in the aforementioned patent and patent application, would be approximately 25 feet in length and 4 feet wide with a spacing of approximately 2 feet between the upper surface of the conveyor and the under surface of the roof of the preheater hood. The roof assemblies of preheaters heretofore known and of the type set forth in the foregoing patent and patent application are precast in one or two large sections and the entire roof assembly is then supported upon the side walls. The roof assemblies alone of preheaters heretofore known, of course depending upon the size, range in weight from 5 to 20 tons.

The side walls of the roof assemblies of such preheater hoods are formed of metal casings and are lined with a refractory material usually several inches thick. The refractory material is subjected to extreme temperatures and temperature changes as well as excessive vibration resulting primarily from the conveyor which is usually of a vibratory type. Over a period of time, the refractory material, more particularly that in the roof of the preheater hood, becomes loose and otherwise will generally suffer from the effects of the heat extremes and vibration. Additionally, the conveyor itself is subjected to extreme temperature due to the flames striking the scrap upon the conveyor and the conveyor itself very often is in need of repair.

When maintenance is required upon the conveyor and/or the preheater hood of the designs heretofore known, extreme difficulty is encountered. Firstly, the spacing between the conveyor and the roof assembly makes it very difficult to work upon either the conveyor or the under surface of the preheater roof as well as the side walls thereof. Additionally, the large cranes and other equipment which is usually present during the installation of the equipment is no longer there and extreme difficulty is encountered in raising the extremely heavy roof structures of the preheaters in order to expose the roof and side walls of the preheater as well as the conveyor associated therewith.

OBJECT AND SUMMARY OF INVENTION

It is the object of the present invention to provide improvements to the roof design and structure of preheater hood assemblies which will permit ready access to the under side of the roof assembly, side walls of the preheater hood and conveyor to permit easy inspection and repair of the preheater hood and associated conveyor.

The foregoing object is carried out by means of the present invention through the utilization of a plurality of preheater modular roof assemblies which may be independently removed from the preheater assembly without removal of the other modules to permit ready access to the under surface of the particular module, side walls of the preheater hood and conveyor beneath the particular module.

The plurality of modules are constructed so as to be supported upon the side walls of the preheater hood and are positioned in side by side arrangement one to another transverse to the longitudinal axis of the preheater hood. The preheater modular roof assemblies include a rectangular roof supporting frame which is carried by the side walls of the preheater hood. A precast refractory assembly is secured to the roof supporting frame and depends therefrom downwardly and is in sealing engagement with the side walls of the preheater hood assembly and in abutting side by side engagement with the adjacent precast refractory assemblies of adjacent modular roof assemblies.

Removable butt joint cover plates and associated hardware interconnect the adjacent modular roof assemblies at the point where they abut one another. A particular module may be removed by removal of the butt joint cover plate and the entire modular roof assembly removed at any desired location to permit repair of the conveyor beneath that particular module or the refractory of the side walls or that portion of the roof of the preheater hood associated with that particular modular roof assembly as is required.

Other objects and advantages of the present invention will become apparent to those skilled in the art from the detailed description thereof which follows taken in conjunction with the drawings.

DETAILED DESCRIPTION OF INVENTION

Figure 1:
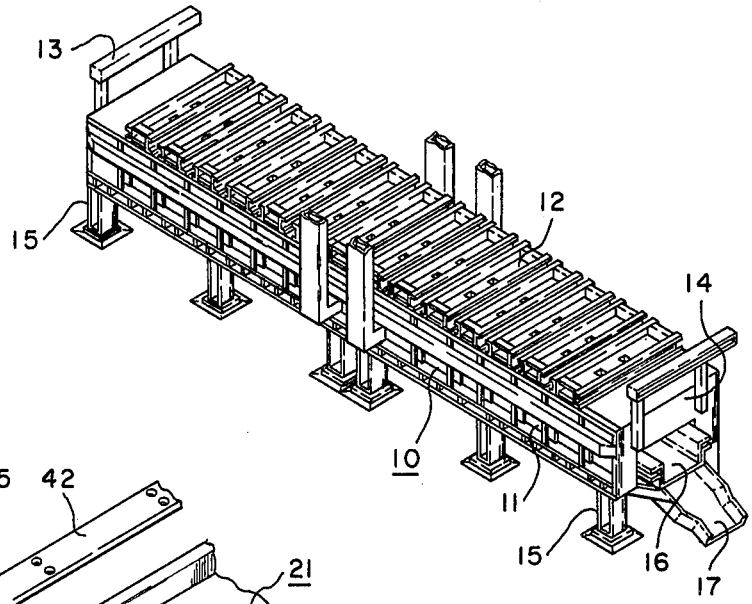
FIG. 1 is a perspective view of the scrap preheater system utilizing the improvements according to the present invention.

Referring now to FIG. 1 of the drawings, there is shown a typical preheater assembly to which the present invention is applicable. A typical scrap preheater assembly 10 is of a tunnel like configuration and includes side walls 11 and a roof structure 12 with an entrance door 13 at one end and an exit door 14 at the opposite end. The entire preheater assembly is typically supported upon I beam supports 15.

Positioned within the tunnel like preheater 10 is a conveyor 16 which is typically of the vibratory type. The conveyor discharges onto a discharge chute 17. The details of such equipment as the conveyor loading apparatus, burner assemblies which are positioned into burner ports 18 (FIG. 4), gas and air lines and exhaust systems have not been shown and reference should be made to the aforementioned patent and patent application for the details of such structures as well as the operation of the preheater, all of which is set out in detail therein.

Figure 3:
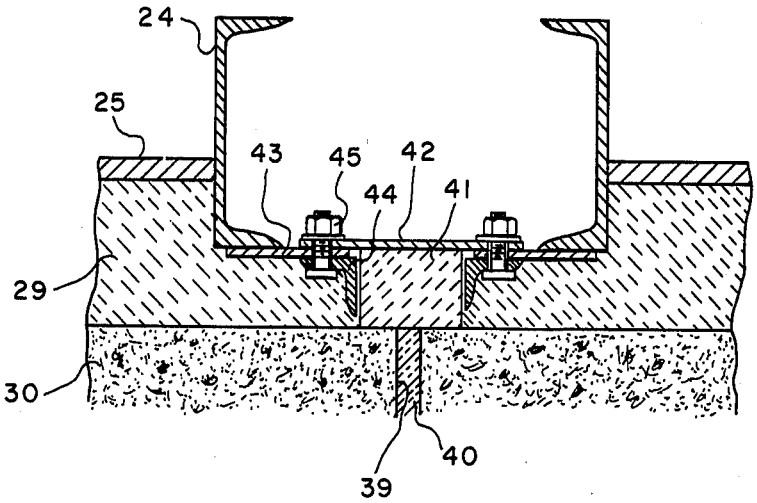
FIG. 3 is a sectional view taken along the lines 3—3 of FIG. 2.
Figure 4:
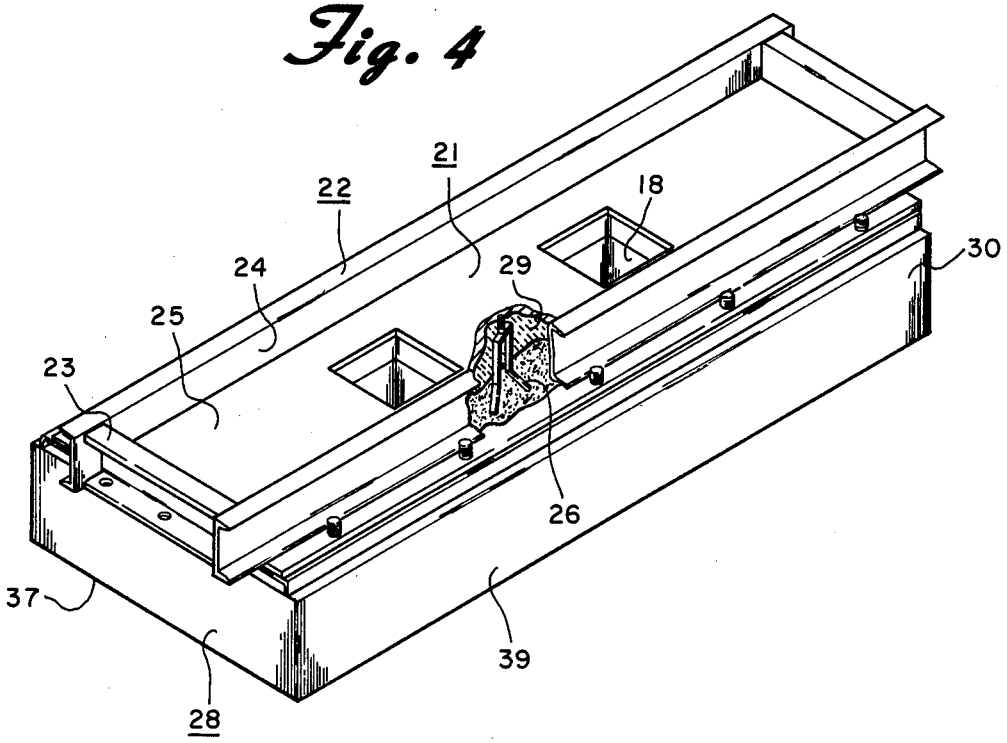
FIG. 4 is a perspective view partially cut away of a complete modular roof assembly according to the present invention.

Reference is now made to FIGS. 3 and 4 wherein the details of a precast refractory modular roof assembly is shown. The precast modular roof assembly 21 includes a roof suspension frame 22 which is contructed of parallel channel iron end rails 23 welded between parallel channel iron side rails 24. A roof plate 25 is welded into the inner rectangular space between the end rails and side rails approximately midway upwardly of the end and side rails as shown in more detail in FIG. 3.

As shown in the cut away portion of FIG. 4, a plurality of refractory anchors 26 are secured to the under surface of the roof plate 25. These Y anchors 26 may be stud welded or secured to the under surface of the roof plate by any suitable means and are of a length of several inches and are designed to depend downwardly from the roof plate approximately the depth of the desired thickness of the refractory material for the roof lining as to be described hereinafter.

A precast refractory assembly 28 is secured to the roof suspension frame 22 as shown in FIG. 4. The precast refractory assembly is cast in a mold in which the roof suspension frame 22 is appropriately positioned such that the refractory anchors 26 will be properly positioned during casting. The precast refractory assembly includes an upper insulating cast refractory layer 29 adjacent the roof plate and a lower cast refractory layer 30 both of which are held in place to the roof suspension frame 22 by means of the refractory lining anchors 26.

Figure 2:
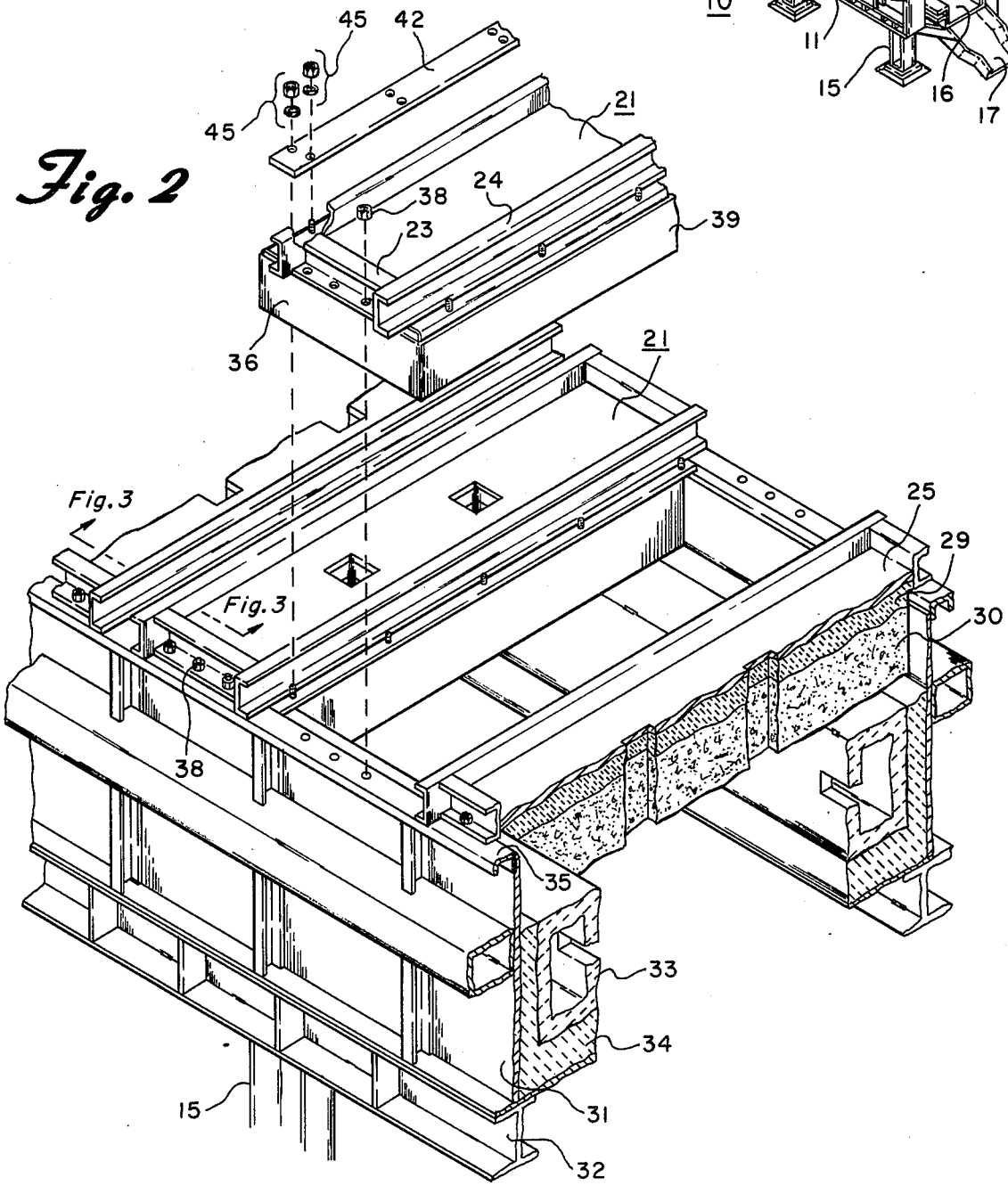
FIG. 2 is a partial perspective view also partially exploded of the side wall and roof assembly of the preheater shown in FIG. 1.

The details of the positioning of each preheater modular roof assembly 21 with respect to the remainder of the preheater hood assemblies is shown in FIG. 2. The preheater hood assembly includes preheater side walls 31 which are supported upon supporting I beams 32 and which themselves support longitudinally extending flue tiles 33 embedded in a cast refractory material 34 all as more particularly described in the aforementioned patent and patent application.

As shown in FIGS. 2 and 4, the opposite ends of the side rails 24 are designed to extend beyond the ends of the precast refractory assembly. In this manner, the entire preheater modular roof assembly 21 may be positioned in side by side relationship with adjacent preheater modular roof assemblies with the entire assembly being supported upon the upper wall flanges 35 of the preheater side walls 31 upon the ends of the side rails 24 as shown in FIG. 2.

The length of the precast refractory assembly 28 as well as the thickness thereof are such that the end walls 36 of the precast refractory assembly come into close engagement with the inner surface of the preheater side walls 31 and also such that the under surface 37 of the precast refractory assembly 28 rests upon the upper surface of the flue tile 33 and cast refractory 34 as shown in FIG. 2. A suitable insulating blanket (not shown) such as a Woolite insulating blanket may be placed between the under surface of the precast refractory assembly and the upper surface of the flue tile 33 and cast refractory 34 to provide an insulating seal as well as a gas tight seal.

The entire preheater modular roof assembly 21 is held in place upon the side walls 31 by means of a plurality of nut and bolt assemblies 38 which secure the end rails 23 of each modular roof assembly to the upper wall flange 35 of each side wall 31 as shown in FIG. 2.

The manner in which each preheater modular roof assembly 21 is secured in side by side relationship to the adjacent preheater modular roof assembly is shown in FIG. 3. During assembly of the preheater modular roof assemblies, the side walls 39 of the precast refractory assemblies of each preheater modular roof assembly is brought into engagement with a Woolite fibrous packing 40 positioned between the side walls 39 of the precast modular roof assemblies. Thereafter, the void between the upper insulating cast refractory 29 is filled with a refractory block mix 41 which seals the fibrous packing 40 in place between the cast refractory layers 30.

After the block mix 41 is in place and has set, a butt joint cover plate 42 is positioned over the block mix 41. Each side rail 24 includes a side rail extension plate 43 welded to the side rail 24. The side rail extension plate 43 also includes, welded thereto, a down-turned angle iron 44, which provides the foundation for a plurality of joint bolt assemblies 45 positioned along the side rail extension plate 43. The joint bolt assemblies 45 cooperate with bolt holes in the butt joint cover plate 42 and, when the assembly is bolted together, the butt joint cover plate 42 provides a rigid interconnection between the preheater modular roof assemblies as well as providing a gas tight seal between the assemblies.

Whenever conditions require that the conveyor be repaired or the side walls or under surface 37 of the preheater hood be repaired, all that is necessary is to remove the joint bolts 45 and associated butt joint cover plate 42 at the sides of the particular preheater modular roof assembly at which the condition occurs and remove the modular roof assembly from the preheater assembly. In this manner, ready access may be had to the conveyor or the side walls of the preheater hood or, as the case may be, to the under surface 37 of the particular modular roof assembly involved. By reason of the foregoing invention, considerable labor and expense is saved whenever a repair is necessary to the preheater assembly as well as valuable time being saved due to the relatively short time necessary to effect the repair.

The scrap preheating system of the present invention has been described in respect to a particular embodiment thereof shown in the drawings. It is, however, to be understood that other variations and modifications of the system disclosed may be made without departing from the scope and spirit of the appended claims.

We claim:

1. In a scrap preheating system including a conveyor upon which the scrap to be preheated is positioned, an elongate preheater hood having side walls adjacent the conveyor and a roof assembly including burner means for directing flames upon the scrap, the improvements in the preheater roof assembly permitting ease of repair to the conveyor and preheater hood itself comprising:

a plurality of precast refractory modular roof assemblies of substantially identical configuration positioned in side by side relation transverse to the longitudinal axis of the preheater hood, each modular roof assembly including a roof supporting frame carried by the side walls of the preheater hood and a precast refractory assembly supported by the roof supporting frame and depending from the roof supporting frame in close engagement with the side walls of the preheater hood.

2. The improvements in the preheater roof assembly of claim 1 wherein the precast refractory assembly is of generally rectangular configuration having end walls and side walls wherein the end walls of the refractory assembly are in close engagement with the side walls of the preheater hood and the side walls of a given precast refractory assembly are positioned in close engagement with the side wall of the next adjacent precast refractory assembly.

3. The improvements in the preheater roof assembly of claim 1 wherein the side walls of the preheater hood include inwardly projecting ledges extending the length of the preheater hood and wherein the precast refractory assembly includes an under surface which is positioned in contact with the ledge to provide a gas tight seal.

4. The improvements in the preheater roof assembly of claim 3 further including a layer of blanket insulation positioned between the under surface of the precast refractory assembly and the ledge of the side walls of the preheater hood to enhance the gas seal.

5. The improvements in the preheater roof assembly of claim 3 wherein the precast refractory assembly is of generally rectangular configuration having end walls and side walls wherein the end walls of the refractory assembly are in close engagement with the side walls of the preheater hood and the side walls of a given precast refractory assembly are positioned in close engagement with the side wall of the next adjacent precast refractory assembly.

6. The improvements in the preheater roof assembly of claim 5 further including removable butt joint sealing means between adjacent modular roof assemblies permitting removal of one or more assemblies without disturbing adjacent assemblies.

* * * * *